US011295667B2

(12) United States Patent
Yuan et al.

(10) Patent No.: US 11,295,667 B2
(45) Date of Patent: Apr. 5, 2022

(54) PIXEL STRUCTURE, DISPLAY PANEL AND CONTROL METHOD THEREOF

(71) Applicants: Hefei BOE Joint Technology Co., Ltd., Anhui (CN); BOE Technology Group Co., Ltd., Beijing (CN)

(72) Inventors: Zhidong Yuan, Beijing (CN); Yongqian Li, Beijing (CN); Song Meng, Beijing (CN); Can Yuan, Beijing (CN)

(73) Assignees: Hefei BOE Joint Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/916,147

(22) Filed: Jun. 30, 2020

(65) Prior Publication Data

US 2021/0097933 A1 Apr. 1, 2021

(30) Foreign Application Priority Data

Sep. 26, 2019 (CN) ..... 201910917801.7

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC ... G09G 3/3233; G09G 3/3266; G09G 3/3291
See application file for complete search history.

(56) References Cited

U.S. PATENT DOCUMENTS 9,171,500 B2 10/2015 Chaji et al.
10,388,207 B2 8/2019 Chang et al.
2015/0002501 A1 1/2015 Choo et al.
(Continued)

FOREIGN PATENT DOCUMENTS

CN 104658485 A 5/2015
CN 104809986 A 7/2015
(Continued)

OTHER PUBLICATIONS

Office Action dated Jul. 23, 2020 for Chinese Patent Application No. 201910917801.7 and English Translation.
(Continued)

*Primary Examiner* — Stacy Khoo
(74) *Attorney, Agent, or Firm* — Ling Wu; Stephen Yang; Ling and Yang Intellectual Property

(57) ABSTRACT

Provided are a pixel structure, a display panel and a control method thereof. The pixel structure includes four sub-pixel units, wherein the i-th sub-pixel unit includes: an i-th element to be driven and an i-th drive circuit, 1≤i≤4, and the i-th drive circuit is respectively connected with an M-th data line and an N-th scanning line, and is configured to drive the i-th element to be driven according to a data signal of the M-th data line under control of the N-th scanning line, $$M = \begin{cases} 1, 1 \le i \le 2 \\ 2, 3 \le i \le 4 \end{cases}, N = \begin{cases} 1, 2 \le i \le 3 \\ 2, i \text{ is 1 or 4} \end{cases}.$$

5 Claims, 7 Drawing Sheets

(56) References Cited

U.S. PATENT DOCUMENTS

| | | | |
|---|---|---|---|
| 2015/0170565 | A1 | 6/2015 | Hong et al. |
| 2016/0012798 | A1 | 1/2016 | Oh et al. |
| 2016/0286622 | A1 | 9/2016 | Gai et al. |
| 2017/0169767 | A1 | 6/2017 | Song |
| 2019/0035335 | A1 | 1/2019 | Kim et al. |
| 2020/0202786 | A1 | 6/2020 | Li et al. |

FOREIGN PATENT DOCUMENTS

| | | | |
|---|---|---|---|
| CN | 105321456 | A | 2/2016 |
| CN | 108766993 | A | 11/2018 |
| CN | 109308879 | A | 2/2019 |
| CN | 109523954 | A | 3/2019 |

OTHER PUBLICATIONS

Office Action dated Dec. 17, 2020 for Chinese Patent Application No. 201910917801.7 and English Translation.

PIXEL STRUCTURE, DISPLAY PANEL AND CONTROL METHOD THEREOF

CROSS-REFERENCE TO RELATED APPLICATION

The present application claims the priority of the Chinese patent application No. 201910917801.7 filed to the CNIPA on Sep. 26, 2019, the content of which is hereby incorporated by reference.

TECHNICAL FIELD

Embodiments of the present disclosure relate to but are not limited to the technical field of display, in particular to a pixel structure, a display panel and a control method thereof.

BACKGROUND

Organic Light-Emitting Diode (OLED) display, as a current-type light-emitting device, has advantages such as self-luminescence, fast response, wide viewing angle and being makable to a flexible substrate, etc., and has been widely applied in the field of high-performance display. According to a driving mode, OLED may be divided into Passive Matrix Driving OLED (PMOLED) and Active Matrix Driving OLED (AMOLED). AMOLED displays have advantages such as low manufacturing cost, high response speed, power saving, direct current drive available for portable devices, large operating temperature range, etc., and are expected to ban Liquid Crystal Display (LCD) to become a mainstream choice for next generation displays.

Uniformity of light emission of an OLED display panel mainly depends on a drive transistor part and a light emitting device part. In general, a pixel compensation circuit which compensates threshold voltage of a drive transistor may be used to eliminate an influence of the threshold voltage of the drive transistor and its mobility on light emission uniformity. However, in some technologies, a quantity of data lines included in each pixel structure is usually more, which does not facilitate reducing a pixel layout space and realizing high resolution.

SUMMARY

The following is a summary of the subject matter described in detail herein. This summary is not intended to limit the protection scope of the claims.

An embodiment of the present disclosure provides a pixel structure, including: four sub-pixel units, the i-th sub-pixel unit includes: an i-th element to be driven and an i-th drive circuit, $1 \le i \le 4$, wherein, the first drive circuit is respectively connected with a first data line and a second scanning line, and is configured to drive the first element to be driven according to a data signal of the first data line under control of the second scanning line; the second drive circuit is respectively connected with the first data line and a first scanning line, and is configured to drive the second element to be driven according to the data signal of the first data line under control of the first scanning line; the third drive circuit is respectively connected with a second data line and the first scanning line, and is configured to drive the third element to be driven according to a data signal of the second data line under control of the first scanning line; the fourth drive circuit is respectively connected with the second data line and the second scanning line, and is configured to drive the fourth element to be driven according to the data signal of the second data line under control of the second scanning line.

In some possible implementations, the i-th drive circuit includes: a drive sub-circuit, a writing sub-circuit, a detecting sub-circuit, a first storage sub-circuit and a second storage sub-circuit, wherein, the drive sub-circuit is respectively connected with a first node, a first power supply end and a second node, and is configured to generate drive current under control of the first node and the second node; the writing sub-circuit is respectively connected with an M-th data line, an N-th scanning line and the first node, and is configured to provide a data signal of the M-th data line to the first node under control of the N-th scanning line; wherein, $$M = \begin{cases} 1, 1 \le i \le 2 \\ 2, 3 \le i \le 4 \end{cases}, N = \begin{cases} 1, 2 \le i \le 3 \\ 2, i \text{ is 1 or 4} \end{cases};$$

the detecting sub-circuit is respectively connected with the N-th scanning line, an induction signal line and the second node, is configured to provide reference voltage provided by the induction signal line to the second node under control of the N-th scanning line, and is further configured to provide a signal of the second node to the induction signal line under the control of the N-th scanning line; the first storage sub-circuit is respectively connected with the first node and the second node, and is configured to store an amount of charge between the first node and the second node; the first storage sub-circuit is respectively connected with the first node and the second node, and is configured to store an amount of charge between the first node and the second node; the i-th element to be driven is respectively connected with the second power supply end and the second node.

In some possible implementations, the drive sub-circuit includes a drive transistor, the writing sub-circuit includes a switch transistor, the detecting sub-circuit includes a detecting transistor, the first storage sub-circuit includes a storage capacitor, and the second storage sub-circuit includes a detecting capacitor, wherein, a control pole of the drive transistor is connected with the first node, a first pole of the drive transistor is connected with the first power supply end, and a second pole of the drive transistor is connected with the second node; a control pole of the switch transistor is connected with the N-th scanning line, a first pole of the switch transistor is connected with the first node, and a second pole of the switch transistor is connected with the M-th data line; a control pole of the detecting transistor is connected with the N-th scanning line, a first pole of the detecting transistor is connected with the induction signal line, and a second pole of the detecting transistor is connected with the second node; an end of the storage capacitor is connected with the first node, and another end of the storage capacitor is connected with the second node; an end of the detecting capacitor is connected with the second node, and another end of the detecting capacitor is connected with the second power supply end.

In some possible implementations, induction signal lines of the second drive circuit and the third drive circuit are a same induction signal line.

An embodiment of the present disclosure provides a display panel. The display panel includes the pixel structure as described above, and further includes a sensing compensation circuit, a compensator and a memory. The i-th drive circuit is respectively connected with an induction signal line. An input end of the sensing compensation circuit is respectively connected with the induction signal line of the i-th drive circuit, and an output end of the sensing compensation circuit is connected with the compensator, and is configured to acquire an amount of charge flowing through the i-th element to be driven within a preset sensing time, and output the amount of the charge to the compensator. The compensator is configured to calculate a voltage difference value corresponding to the amount of the charge flowing through the i-th element to be driven within the preset sensing time, obtain a compensation gain value of the i-th element to be driven according to the calculated voltage difference value, and store the compensation gain value in the memory for use during a next display period.

In some possible implementations, the sensing compensation circuit includes a current integrator, a sampling switch and an analog-to-digital converter which are connected in sequence, wherein, an input end of the current integrator is connected with the induction signal line, and an output end of the current integrator is connected with a first path end of the sampling switch; a second path end of the sampling switch is connected with an input end of the analog-to-digital converter, and a control end of the sampling switch receives a sampling signal; an output end of the analog-to-digital converter is connected with the compensator.

In some possible implementations, the amount of the charge flowing through the i-th element to be driven within the preset sensing time and the voltage difference value corresponding to the amount of the charge satisfy: Qfi=(Vcomp*ai(1+ai)+Voledi)Coledi; wherein, Qfi is the amount of the charge flowing through the i-th element to be driven within the preset sensing time, Vcomp is induction data voltage, ai is a ratio of a detecting capacitor of the i-th drive circuit to an amount of capacitance of the storage capacitor, Voledi is a voltage difference value corresponding to the amount of the charge flowing through the i-th element to be driven within the preset sensing time, and Coledi is an amount of capacitance of the detecting capacitor of the i-th drive circuit.

In some possible implementations, the compensation gain value of the i-th element to be driven satisfies: Gaini=Voledi0/Voledi; wherein Gaini is the compensation gain value of the i-th element to be driven, and Voledi0 is a preset voltage threshold value of the i-th element to be driven.

An embodiment of the present disclosure also provides a method for controlling a pixel structure, applied to the pixel structure as described in any previous one. When display is driven, a drive timing of the pixel structure includes: a scanning stage and an induction stage. In the scanning stage, the method for controlling the pixel structure includes: providing a turn-on voltage signal to the first scanning line, providing a turn-off voltage signal to the second scanning line, providing a display data signal to the first data line, and writing the display data signal into the second sub-pixel unit through the first data line; providing a display data signal to the second data line, and writing the display data signal into the third sub-pixel unit through the second data line; providing a turn-off voltage signal to the first scanning line, providing a turn-on voltage signal to the second scanning line, providing a display data signal to the first data line, and writing the display data signal into the first sub-pixel unit through the first data line; and providing a display data signal to the second data line, and writing the display data signal into the fourth sub-pixel unit through the second data line. In the induction stage, the method for controlling the pixel structure includes: providing a turn-on voltage signal to the first scanning line and the second scanning line respectively, providing an induction data signal to the first data line, and writing the induction data signal into the first sub-pixel unit and the second sub-pixel unit respectively through the first data line; providing a turn-off voltage signal to the first scanning line and the second scanning line respectively, wherein the first element to be driven and the second element to be driven respectively emit light; providing a turn-on voltage signal to the first scanning line, providing a turn-off data signal to the first data line, and writing the turn-off data signal into the second sub-pixel unit through the first data line; providing a turn-on voltage signal to the first scanning line, and reading charge stored in the second drive circuit from the induction signal line connected with the second drive circuit in the second sub-pixel unit.

An embodiment of the present disclosure also provides a method for controlling a display panel, used for controlling the display panel as described in any previous one, and the method for controlling the display panel includes: providing, by a timing controller, a turn-on voltage signal to the first scanning line and the second scanning line respectively, providing an induction data signal to the first data line, and writing the induction data signal into the first sub-pixel unit and the second sub-pixel unit respectively through the first data line; providing, by the timing controller, a turn-off voltage signal to the first scanning line and the second scanning line respectively, wherein the first element to be driven and the second element to be driven respectively emit light; providing, by the timing controller, a turn-on voltage signal to the first scanning line, providing a turn-off data signal to the first data line, and writing the turn-off data signal into the second sub-pixel unit through the first data line; providing, by the timing controller, a turn-off voltage signal to the first scanning line, reading, by the sensing compensation circuit, an amount of charge flowing through the second element to be driven within a preset sensing time from the induction signal line connected with the second drive circuit, and outputting the amount of the charge to the compensator; calculating, by the compensator, a voltage difference value corresponding to the amount of the charge flowing through the second element to be driven within the preset sensing time, obtaining a compensation gain value of the second element to be driven according to the calculated voltage difference value, and storing the compensation gain value in the memory for use during a next display period.

Other aspects may become apparent upon reading and understanding the brief description of the drawings and embodiments of the present disclosure.

BRIEF DESCRIPTION OF DRAWINGS

Accompanying drawings are used for providing a further understanding of technical solutions of embodiments of the present disclosure, and form a part of the specification. Together with embodiments of the present disclosure, the accompanying drawings are used for explaining technical solutions of embodiments of the present disclosure, and do not constitute a limitation on the technical solutions of the embodiments of the present disclosure.

DESCRIPTION OF THE REFERENCE SIGNS

VDD—First power supply end; Vref—Induction signal line;

VSS—Second power supply end; EL, EL1, EL2—Element to be driven;

DL, DL1—Data line; Sense—Sampling switch;

ADC—Analog to digital converter;

Scan(n), Scan(n+2), . . . —First scanning line;

Scan(n+1), Scan(n+3), . . . —Second scanning line;

Cst, Cst1-Cst4, Coled1-Coled4—Capacitor;

T1, T2, Td, T11, T12, T1*d*, T21, T22, T2*d*, T31, T32, T3*d*, T41, T42, T4*d*-Transistor.

DETAILED DESCRIPTION

Hereinafter, embodiments of the present disclosure will be described in detail with reference to the accompanying drawings. Embodiments in the present disclosure and features in the embodiments may be combined with each other arbitrarily if there is no conflict.

Unless otherwise defined, technical terms or scientific terms used and disclosed in the embodiments of the disclosure shall possess the general meaning understood by those with general skills in the field to which the disclosure pertains. The words "first", "second" and the like used in the embodiments of the present disclosure do not indicate any order, quantity or importance, but are only used for distinguishing different components. The word "including", "containing", or the like means that an element or an article appearing before the word covers elements or articles listed after the word and their equivalents and does not exclude other elements or articles.

Those skilled in the art may understand that transistors used in the embodiments of the present disclosure may be thin film transistors or field-effect tubes or other devices with same characteristics. The thin film transistor used in the embodiments of the present disclosure may be an oxide semiconductor transistor. Since a source and a drain of a transistor used here are symmetrical, the source and the drain may be interchanged. In the embodiments of the present disclosure, to distinguish two poles of the transistor except a gate, one of the poles is referred to as a first pole and the other pole is referred to as a second pole. The first pole may be a source or a drain, and the second pole may be a drain or a source.

Figure 1:
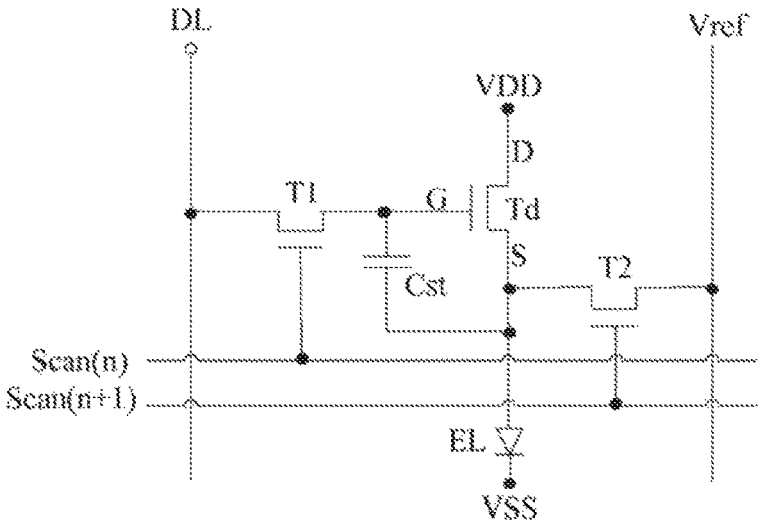
FIG. 1 is a schematic structural diagram of a pixel circuit.

FIG. 1 is a schematic structural diagram of a pixel circuit. As shown in FIG. 1, the pixel circuit includes a switch transistor T1, a detecting transistor T2, a drive transistor Td and a storage capacitor Cst, wherein a first pole of the switch transistor T1 is connected with a corresponding data line DL, a control pole of the switch transistor T1 is connected with a corresponding scanning line Scan(n), and a second pole of the switch transistor T1 is respectively connected with a first end of the storage capacitor Cst and a control pole of the drive transistor Td; a first pole of the drive transistor Td is connected with a first power supply end VDD, a second pole of the drive transistor Td is respectively connected with a second end of the storage capacitor Cst, an anode of an element to be driven EL and a first pole of the detecting transistor T2, and a cathode of the element to be driven EL is connected with a second power supply end VSS; a second pole of the detecting transistor T2 is connected with an induction signal line Vref, and a control pole of the detecting transistor T2 is connected with a corresponding scanning line Scan(n+1).

Figure 2:
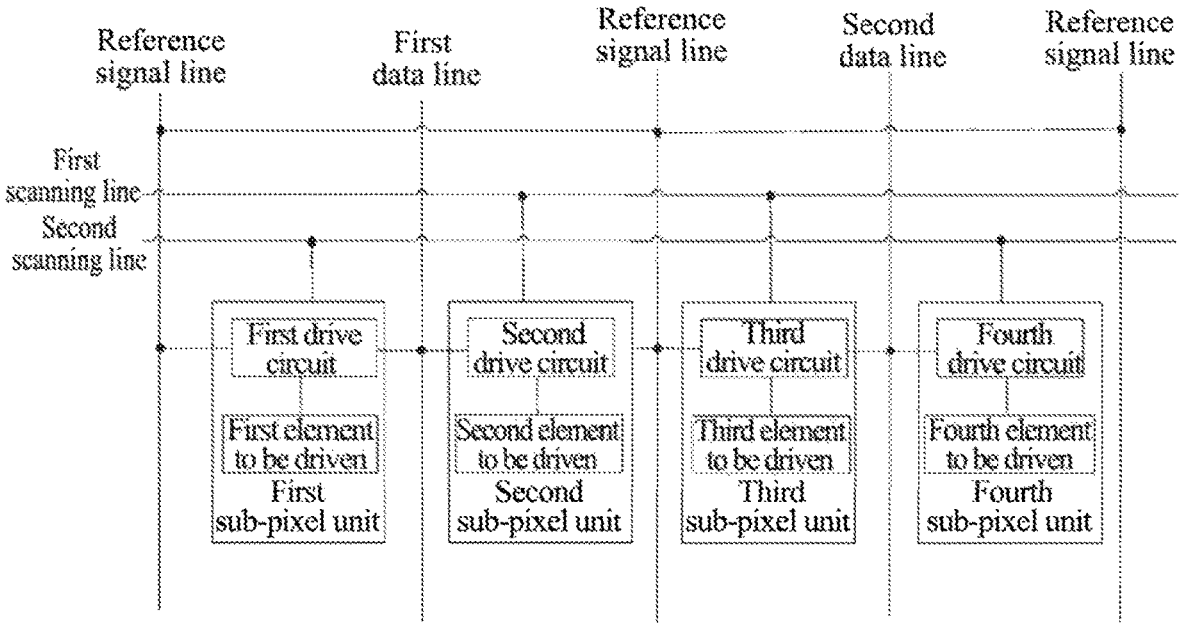
FIG. 2 is a schematic diagram of an exemplary pixel structure according to an embodiment of the present disclosure.

FIG. 2 is a schematic structural diagram of a pixel structure according to an embodiment of the present disclosure. As shown in FIG. 2, a pixel structure according to the embodiment of the present disclosure includes: four sub-pixel units, wherein the i-th sub-pixel unit includes an i-th element to be driven and an i-th drive circuit, $1 \le i \le 4$.

Herein, the first drive circuit is respectively connected with a first data line and a second scanning line, and is configured to drive the first element to be driven according to a data signal of the first data line under control of the second scanning line.

The second drive circuit is respectively connected with the first data line and a first scanning line, and is configured to drive the second element to be driven according to the data signal of the first data line under control of the first scanning line.

The third drive circuit is respectively connected with a second data line and the first scanning line, and is configured to drive the third element to be driven according to a data signal of the second data line under control of the first scanning line.

The fourth drive circuit is respectively connected with the second data line and the second scanning line, and is configured to drive the fourth element to be driven according to the data signal of the second data line under control of the second scanning line.

The pixel structure of the embodiment of the present disclosure reduces a quantity of data lines, facilitates reducing a pixel layout space and realizing high resolution, shortens compensation control time, and improves compensation speed.

In an exemplary embodiment, the first to the fourth elements to be driven may be organic light emitting diodes (OLEDs), micro light emitting diodes (micro LEDs), or submillimeter light emitting diodes (mini LEDs).

Figure 3:
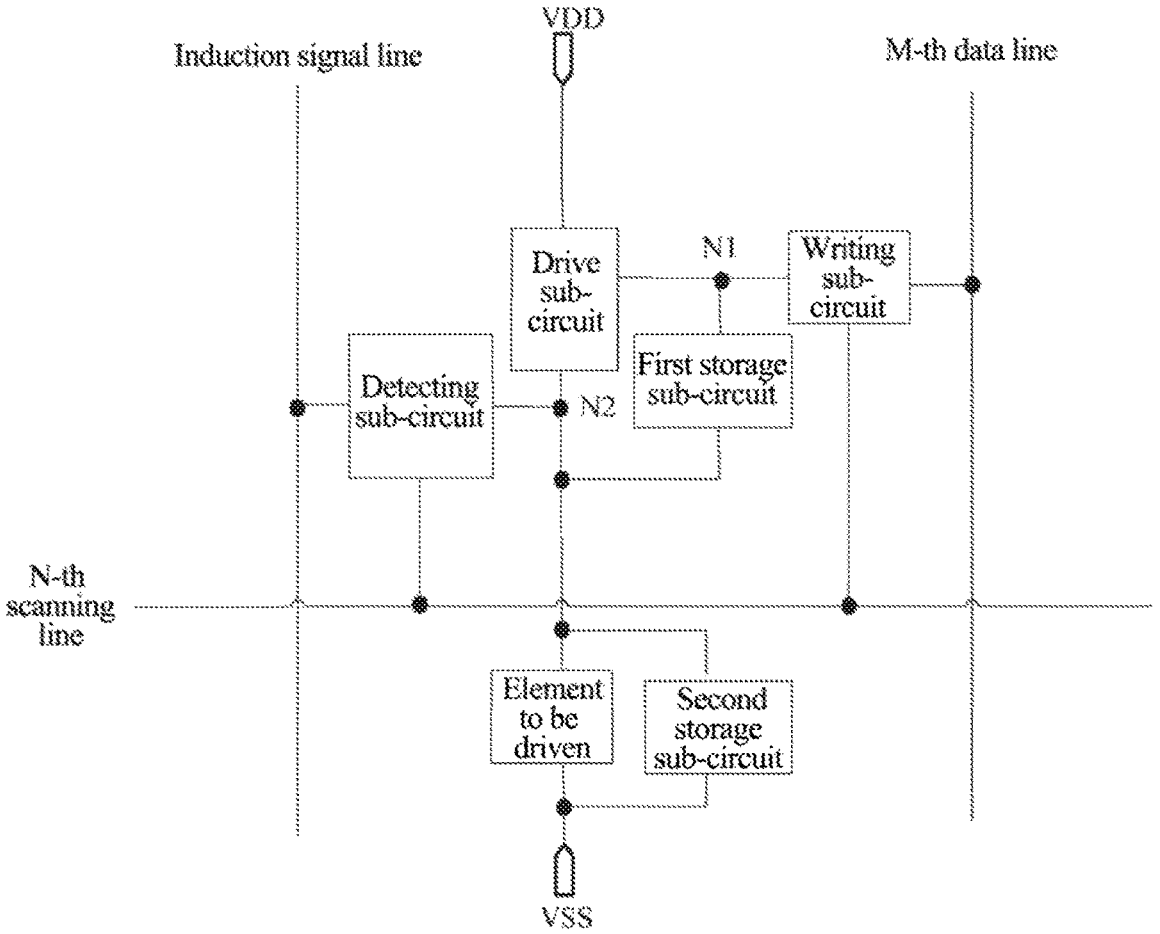
FIG. 3 is a schematic structural diagram of an i-th drive circuit according to an embodiment of the present disclosure.

In an exemplary embodiment, as shown in FIG. 3, the i-th drive circuit may include: a drive sub-circuit, a writing sub-circuit, a detecting sub-circuit, a first storage sub-circuit and a second storage sub-circuit.

Herein, the drive sub-circuit is respectively connected with a first node N1, a first power supply end VDD and a second node N2, and is configured to generate drive current under control of the first node N1 and the second node N2.

The writing sub-circuit is respectively connected with an M-th data line, an N-th scanning line and the first node N1, and is configured to provide a data signal of the M-th data line to the first node N1 under control of the N-th scanning line; wherein $$M = \begin{cases} 1, 1 \le i \le 2 \\ 2, 3 \le i \le 4 \end{cases}, N = \begin{cases} 1, 2 \le i \le 3 \\ 2, i \text{ is } 1 \text{ or } 4 \end{cases}.$$

The detecting sub-circuit is respectively connected with the N-th scanning line, an induction signal line and the second node N2, is configured to provide reference voltage provided by the induction signal line to the second node N2 under control of the N-th scanning line, and is further configured to provide a signal of the second node N2 to the induction signal line under the control of the N-th scanning line.

The first storage sub-circuit is respectively connected with the first node N1 and the second node N2, and is configured to store an amount of charge between the first node and the second node.

The second storage sub-circuit is respectively connected with a second power supply end VSS and the second node N2, and is configured to store an amount of charge flowing through the i-th element to be driven.

The i-th element to be driven is respectively connected with the second power supply end VSS and the second node N2.

In an exemplary embodiment, the drive sub-circuit may include a drive transistor, the writing sub-circuit may include a switch transistor, the detecting sub-circuit may include a detecting transistor, the first storage sub-circuit may include a storage capacitor, and the second storage sub-circuit may include a detecting capacitor.

Herein, a control pole of the drive transistor is connected with the first node N1, a first pole of the drive transistor is connected with the first power supply end VDD, and a second pole of the drive transistor is connected with the second node N2.

A control pole of the switch transistor is connected with the N-th scanning line, a first pole of the switch transistor is connected with the first node N1, and a second pole of the switch transistor is connected with the M-th data line.

A control pole of the detecting transistor is connected with the N-th scanning line, a first pole of the detecting transistor is connected with the induction signal line, and a second pole of the detecting transistor is connected with the second node N2.

An end of the storage capacitor is connected to the first node N1, and another end of the storage capacitor is connected to the second node N2.

An end of the detecting capacitor is connected with the second node N2, and another end of the detecting capacitor is connected with the second power supply end VSS.

Figure 4:
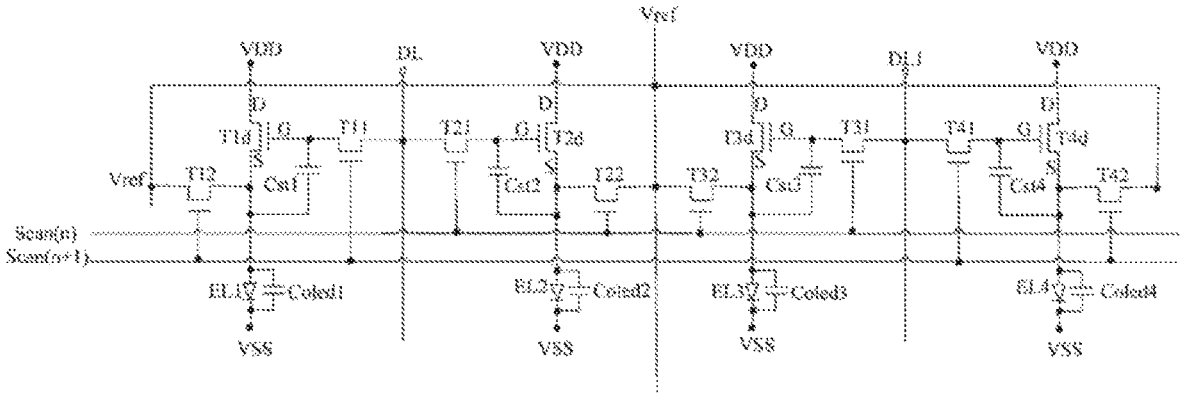
FIG. 4 is an equivalent circuit diagram of a pixel structure according to an embodiment of the present disclosure.

FIG. 4 is an equivalent circuit diagram of a pixel structure according to an embodiment of the present disclosure. As shown in FIG. 4, the first drive circuit includes a first switch transistor T11, a first detecting transistor T12, a first drive transistor T1*d*, a first storage capacitor Cst1 and a first detecting capacitor Coled1, the second drive circuit includes a second switch transistor T21, a second detecting transistor T22, a second drive transistor T2*d*, a second storage capacitor Cst2 and a second detecting capacitor Coled2, the third drive circuit includes a third switch transistor T31, a third detecting transistor T32, a third drive transistor T3*d*, a third storage capacitor Cst3, and a third detecting capacitor Coled3, and the fourth drive circuit includes a fourth switch transistor T41, a fourth detecting transistor T42, a fourth drive transistor T4*d*, a fourth storage capacitor Cst4, and a fourth detecting capacitor Coled4.

Herein, the control pole of the first switch transistor T11 is connected with a second scanning line Scan(n+1), a first pole of the first switch transistor T11 is connected with a first data line DL, and a second pole of the first switch transistor T11 is respectively connected with a first end of the first storage capacitor Cst1 and a control pole of the first drive transistor T1*d*.

A first pole of the first drive transistor T1*d* is connected with a first power supply end VDD, and a second pole of the first drive transistor T1*d* is respectively connected with a second end of the first storage capacitor Cst1, a first end of the first detecting capacitor Coled1, an anode of a first element EL1 to be driven, and a first pole of the first detecting transistor T12.

A cathode of the first element EL1 to be driven is respectively connected with a second power supply end VSS and a second end of the first detecting capacitor Coled1.

A control pole of the first detecting transistor T12 is connected with a second scanning line Scan(n+1), and a second pole of the first detecting transistor T12 is connected with an induction signal line Vref.

A control pole of the second switch transistor T21 is connected with the first scanning line Scan(n), a first pole of the second switch transistor T21 is connected with the first data line DL, and a second pole of the second switch transistor T21 is respectively connected with a first end of the second storage capacitor Cst2 and a control pole of the second drive transistor T2*d*.

A first pole of the second drive transistor T2*d* is connected with the first power supply end VDD, and a second pole of the second drive transistor T2*d* is respectively connected with a second end of the second storage capacitor Cst2, a first end of the second detecting capacitor Coled2, an anode of a second element EL2 to be driven, and a first pole of the second detecting transistor T22.

A cathode of the second element EL2 to be driven is respectively connected with the second power supply end VSS and a second end of the second detecting capacitor Coled2.

A control pole of the second detecting transistor T22 is connected with the first scanning line Scan(n), and a second pole of the second detecting transistor T22 is connected with the induction signal line Vref.

A control pole of the third switch transistor T31 is connected with the first scanning line Scan(n), a first pole of the third switch transistor T31 is connected with a second data line DL1, and a second pole of the third switch transistor T31 is respectively connected with a first end of the third storage capacitor Cst3 and a control pole of the third drive transistor T3*d*.

A first pole of the third drive transistor T3*d* is connected with the first power supply end VDD, and a second pole of the third drive transistor T3*d* is respectively connected with a second end of the third storage capacitor Cst3, a first end of the third detecting capacitor Coled3, an anode of a third element EL3 to be driven, and a first pole of the third detecting transistor T32.

A cathode of the third element EL3 to be driven is respectively connected with the second power supply end VSS and a second end of the third detecting capacitor Coled3.

A control pole of the third detecting transistor T32 is connected with the first scanning line Scan(n), and a second pole of the third detecting transistor T32 is connected with the induction signal line Vref.

A control pole of the fourth switch transistor T41 is connected with the second scanning line Scan(n+1), a first pole of the fourth switch transistor T41 is connected with the second data line DL1, and a second pole of the fourth switch transistor T41 is respectively connected with a first end of the fourth storage capacitor Cst4 and a control pole of the fourth drive transistor T4*d*.

A first pole of the fourth drive transistor T4*d* is connected with the first power supply end VDD, and a second pole of the fourth drive transistor T4*d* is respectively connected with a second end of the fourth storage capacitor Cst4, a first end of the fourth detecting capacitor Coled4, an anode of a fourth element EL4 to be driven, and a first pole of the fourth detecting transistor T42.

A cathode of the fourth element EL4 to be driven is respectively connected with the second power supply end VSS and a second end of the fourth detecting capacitor Coled4.

A control pole of the fourth detecting transistor T42 is connected with the second scanning line Scan(n+1), and a second pole of the fourth detecting transistor T42 is connected with the induction signal line Vref.

An exemplary structure of an equivalent circuit diagram of the first drive circuit, the second drive circuit, the third drive circuit, and the fourth drive circuit is shown in FIG. 4. Those skilled in the art will readily understand that an implementation of the equivalent circuit diagram of the first drive circuit, the second drive circuit, the third drive circuit and the fourth drive circuit is not limited to this, as long as their respective functions can be realized.

In an exemplary embodiment, the induction signal lines of the second drive circuit and the third drive circuit are the same induction signal line.

According to the embodiment of the present disclosure, through using the same induction signal line in the second drive circuit and the third drive circuit, a quantity of induction signal lines is reduced, and display panel high Pixels Per Inch (PPI) is facilitated to be realized.

In an exemplary embodiment, the first drive transistor T1*d*, the first switch transistor T11, the first detecting transistor T12, the second drive transistor T2*d*, the second switch transistor T21, the second detecting transistor T22, the third drive transistor T3*d*, the third switch transistor T31, the third detecting transistor T32, the fourth drive transistor T4*d*, the fourth switch transistor T41, and the fourth detecting transistor T42 may all be N-type thin film transistors or P-type thin film transistors, which may unify a process flow, can reduce process processes, and helps to improve product yield.

In an exemplary embodiment, considering that leakage current of a low-temperature polysilicon thin film transistor is smaller, all transistors of the embodiment of the present disclosure may be low-temperature polysilicon thin film transistors, and for thin film transistors, the thin film transistors with a bottom gate structure or the thin film transistors with a top gate structure may be selected as long as a switch function can be realized.

In an exemplary embodiment, the first storage capacitor Cst1, the first detecting capacitor Coled1, the second storage capacitor Cst2, the second detecting capacitor Coled2, the third storage capacitor Cst3, the third detecting capacitor Coled3, the fourth storage capacitor Cst4, and the fourth detecting capacitor Coled4 may be liquid crystal capacitors composed of pixel electrodes and common electrodes, or may be equivalent capacitors composed of liquid crystal capacitors composed of pixel electrodes and common electrodes and storage capacitors, and the present disclosure is not limited thereto.

The following further illustrates the technical solution of the embodiment of the present disclosure through an operation process of a pixel structure. In a process of displaying a frame of picture, for the pixel structure according to the embodiment of the present disclosure, when it drives display, a drive display stage includes a scanning stage and an induction stage. Description is given below by taking an operation process of a pixel structure connected with the first scanning line Scan(n), the second scanning line Scan(n+1) and the first data line DL as an example.

Figure 5:
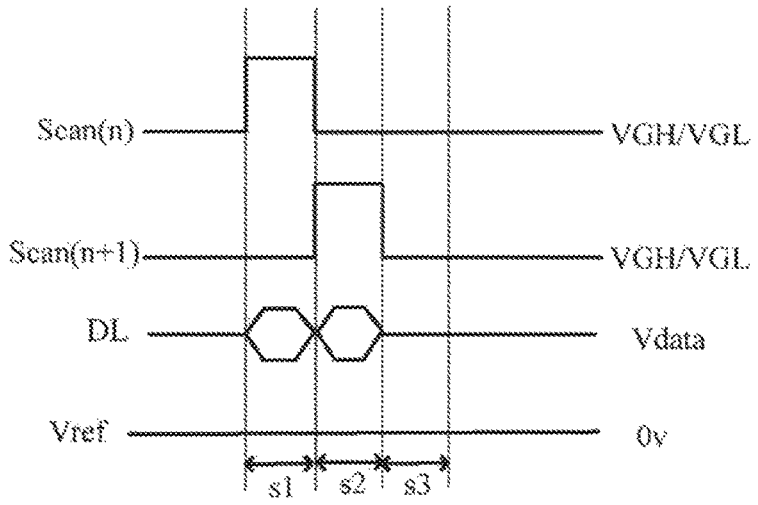
FIG. 5 is an operation timing diagram of a scanning stage of a pixel structure according to an embodiment of the present disclosure.
Figure 6:
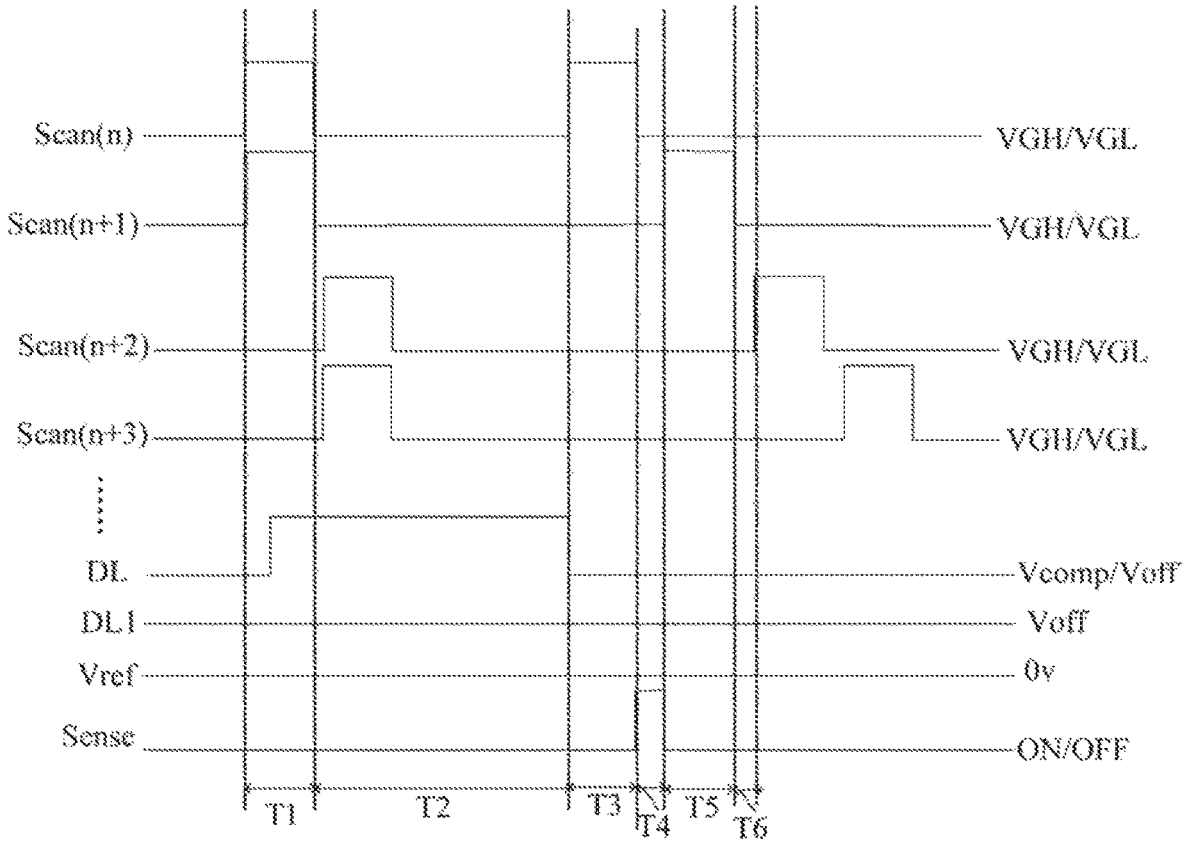
FIG. 6 is an operation timing diagram of an induction stage of a pixel structure according to an embodiment of the present disclosure.

Taking the transistors in the pixel structure according to the embodiment of the present disclosure being all N-type thin film transistors as an example, FIG. 5 is a operation timing diagram of a scanning stage of a pixel structure according to an embodiment of the present disclosure, and FIG. 6 is an operation timing diagram of an induction stage of a pixel structure according to an embodiment of the present disclosure. As shown in FIG. 4, the pixel structure according to the embodiment of the present disclosure includes 12 transistor units (T11, T12, T1*d*, T21, T22, T2*d*, T31, T32, T3*d*, T41, T42, T4*d*), 8 capacitor units (Cst1, Coled1, Cst2, Coled2, Cst3, Coled3, Cst4, Coled4), 3 input ends (a first scanning line Scan(n), a second scanning line Scan(n+1), a data line DL) and 3 power supply ends (a first power supply end VDD, a second power supply end VSS, and an induction signal line Vref). As shown in FIG. 5, VGH is turn-on voltage for a transistor, VGL is turn-off voltage for a transistor, and Vdata is display data voltage. As shown in FIG. 6, Vcomp is induction data voltage, VOFF is turn-off data voltage, Sense is a sampling switch, ON is on, and OFF is off.

In an embodiment of the present disclosure, as shown in FIG. 5, a scanning stage includes multiple sub-stages, for example, in a scanning stage, a first scanning stage S1, a second scanning stage S2, and a third scanning stage S3 are included.

An operation principle of the scanning stage of the pixel structure shown in FIG. 4 will be illustratively explained below with reference to FIG. 5.

Figure 7:
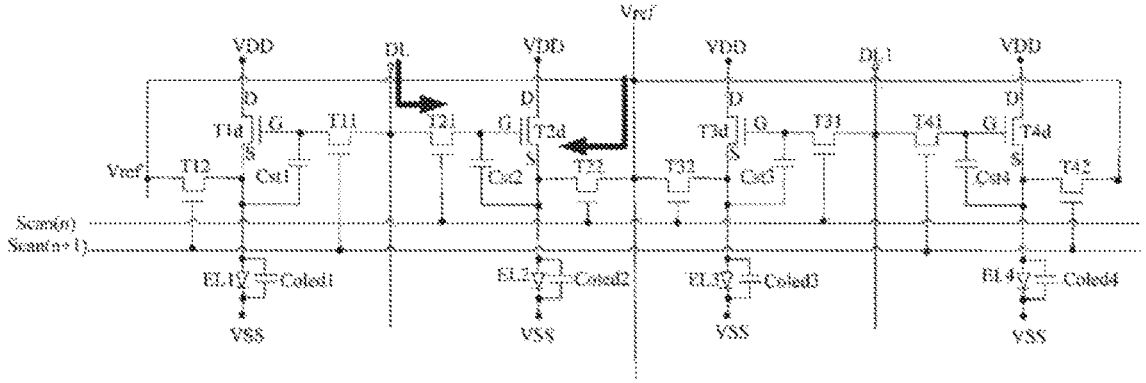
FIG. 7 is a signal flow schematic diagram of a pixel structure in a data input stage of a second sub-pixel according to an embodiment of the present disclosure.

For stage S1, i.e., a data input stage of the second sub-pixel, an input signal of the first scanning line Scan(n) is at a high level, and the second switch transistor T21 and the second detecting transistor T22 are turned on. As shown in FIG. 7, a display data signal Vdata of the first data line DL is written into a control pole of the second drive transistor T2*d* through the second switch transistor T21, a signal of the induction signal line Vref is written into the source of the second drive transistor T2*d* through the second detecting transistor T22 (here, Vref is smaller than turn-on voltage of the second element EL2 to be driven to prevent the second element EL2 to be driven from turning on, for example, Vref may be 0V), gate-source voltage of the second drive transistor T2*d* is Vgs2=Vdata−Vref, and the second element EL2 to be driven does not emit light. An input signal of the second scanning line Scan(n+1) is at a low level, the first switch transistor T11 and the first detecting transistor T12 are off, and the display data signal Vdata will not be written into a control pole of the first drive transistor T1*d*.

For stage S2, i.e. a stage for data input of the first sub-pixel and light emission of the second sub-pixel, an input signal of the first scanning line Scan(n) is at a low level, the second switch transistor T21 and the second detecting transistor T22 are off, the display data signal Vdata will not be written into the control pole of the second drive transistor T2*d*, the second storage capacitor Cst2 maintains the gate voltage of the second drive transistor T2*d*, the second drive transistor T2*d* is turned on, current flows from a power supply high voltage VDD to the source of the second drive transistor T2*d*, source voltage Vs2 of the second drive transistor T2*d* rises, gate voltage Vg2 of the second drive transistor T2*d* rises at the same time due to capacitive coupling effect, the gate-source voltage Vgs2 of the second drive transistor T2*d* remains constant, current flowing through the second drive transistor T2*d* does not change, and the second element EL2 to be driven starts to emit light.

At the same time, an input signal of the second scanning line Scan(n+1) is at a high level, the first switch transistor T11 and the first detecting transistor T12 are turned on, the display data signal Vdata of the first data line DL is written into the control pole of the first drive transistor T1*d* through the first switch transistor T11, the signal of the induction signal line Vref is written into the source of the first drive transistor T1*d* through the first detecting transistor T12 (here, Vref is smaller than turn-on voltage of the first element EL1 to be driven to prevent the first element EL1 to be driven from turning on, for example, Vref may be 0V), the gate-source voltage of the first drive transistor T1*d* is Vgs1=Vdata−Vref, and the first element EL1 to be driven does not emit light.

For stage S3, i.e., a stage for light emission of the first sub-pixel, an input signal of the second scanning line Scan(n+1) is at a low level, the first switch transistor T11 and the first detecting transistor T12 are turned off, the first storage capacitor Cst1 maintains the gate voltage of the first drive transistor T1*d*, the first drive transistor T1*d* is turned on, current flows from the power supply high voltage VDD to the source of the first drive transistor T1*d*, the source voltage Vs1 of the first drive transistor T1*d* rises, the gate voltage Vg1 of the first drive transistor T1*d* rises at the same time due to the capacitive coupling effect, the gate-source voltage Vgs1 of the first drive transistor T1*d* remains constant, current flowing through the first drive transistor T1*d* does not change, and the first element EL1 to be driven starts to emit light.

An operation principle of the induction stage of the pixel structure shown in FIG. 4 will be illustratively explained below with reference to FIG. 6.

Induction of a whole screen needs to be performed by two steps. Firstly, all pixels controlled by the first data line DL are induced in sequence, and then all pixels controlled by the second data line DL1 are induced in sequence. As shown in FIG. 6, taking a first sub-pixel unit and a second sub-pixel unit controlled by a row, in which a first scanning line Scan(n) and a second scanning line Scan(n+1) are located, as well as the first data line DL being induced as an example, one induction period includes six induction time intervals: T1 to T6 stages. The stages T1 to T4 are configured to sense an amount of charge flowing through the first element EL1 to be driven, and the stages T1 to T2 and T5 to T6 are configured to sense an amount of charge flowing through the second element EL2 to be driven. A method for inducing a first sub-pixel unit and a second sub-pixel unit controlled by a row, in which a first scanning line Scan(n) and a second scanning line Scan(n+1) are located, as well as the second data line DL1, and a method for inducing a first sub-pixel unit and a second sub-pixel unit controlled by a row, in which another first scanning line and another second scanning line, e.g., a first scanning line Scan(n+2) and a second scanning line Scan(n+3) are located, are both similar to this, and will not be repeated here.

Figure 8:
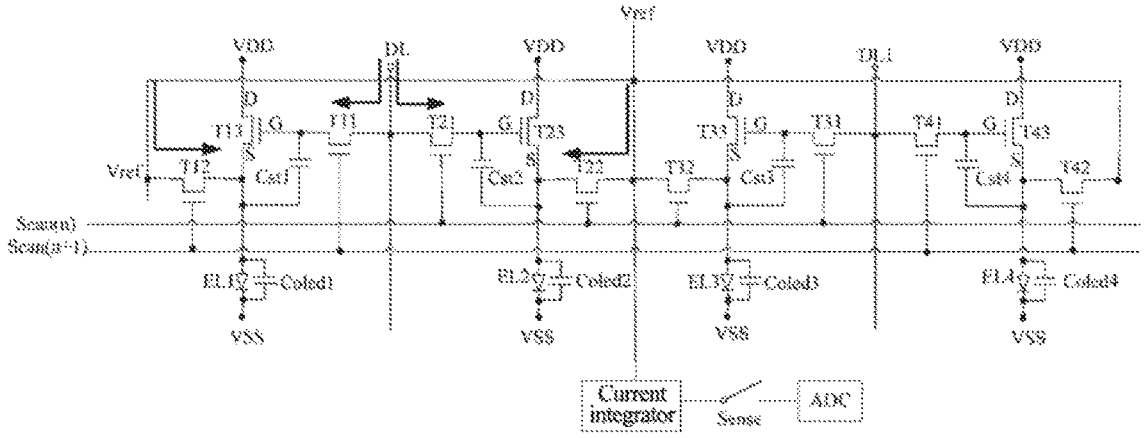
FIG. 8 is a signal flow schematic diagram of a pixel structure in a stage for writing light emission data according to an embodiment of the present disclosure.

For stage T1, i.e., a stage for writing light emission data, input signals of a first scanning line Scan(n) and a second scanning line Scan(n+1) are both high-level turn-on voltage signals VGHs, and the first switch transistor T11, the first detecting transistor T12, the second switch transistor T21 and the second detecting transistor T22 are all turned on, as shown in FIG. 8, an induction data signal Vcomp of the first data line DL is written into a control pole of the first drive transistor T1*d* through the first switch transistor T11, reference voltage Vref of the induction signal line (here Vref may be 0V) is written into a source of the first drive transistor T1*d* through the first detecting transistor T12, gate-source voltage of the first drive transistor T1*d* is Vgs1=Vcomp−Vref=Vcomp, and the first element EL1 to be driven does not emit light. An induction data signal Vcomp of the first data line DL is written into a control pole of the second drive transistor T2*d* through the second switch transistor T21, a signal of the induction signal line Vref is written into a source of the second drive transistor T2*d* through the second detecting transistor T22, and gate-source voltage of the second drive transistor T2*d* is Vgs2=Vcomp−Vref=Vcomp, and the second element EL2 to be driven does not emit light.

Through the pixel structure and the control method thereof according to the embodiment of the present disclosure, two sub-pixel units Sub Pixel (RG or WB) within a same pixel structure (RGWB) in a same row (n rows) may be simultaneously written, and the embodiment of the present disclosure greatly reduces time of the stage for writing light emission data.

For stage T2, i.e., a light emission stage, input signals of a first scanning line Scan(n) and a second scanning line Scan(n+1) are both turn-off voltage signals VGLs of low level, the first switch transistor T11, the first detecting transistor T12, the second switch transistor T21 and the second detecting transistor T22 are all off, the first storage capacitor Cst1 maintains gate voltage of the first drive transistor T1*d*, the first drive transistor T1*d* is turned on, current flows from a power supply high voltage VDD to a source of the first drive transistor T1*d*, source voltage Vs1 of the first drive transistor T1*d* rises, gate voltage Vg1 of the first drive transistor T1*d* rises at the same time due to the capacitive coupling effect, gate-source voltage Vgs1 of the first drive transistor T1*d* remains constant, current flowing through the first drive transistor T1*d* does not change, the first element EL1 to be driven starts to emit light, and the first detecting capacitor Coled1 stores an amount of charge Q1=(Vcomp+Voled1+VSS)Coled1. Voled1 is a voltage difference value corresponding to an amount of charge flowing through the first detecting capacitor Coled1 within a preset sensing time, and Coled1 is an amount of capacitance of the first detecting capacitor Coled1.

Similarly, the second element EL2 to be driven also starts to emit light, and the second detecting capacitor Coled2 stores an amount of charge Q2=(Vcomp+Voled2+VSS) Coled2. Voled2 is a voltage difference value corresponding to an amount of charge flowing through the second detecting capacitor Coled2 within a preset sensing time, and Coled2 is an amount of capacitance of the second detecting capacitor Coled2.

In this stage, S-point potentials of the first drive transistor T1*d* and the second drive transistor T2*d* are led to be raised, and the first detecting capacitor Coled1 and the second detecting capacitor Coled2 respectively store amounts of charge Q1=(Vcomp+Voled1+VSS)Coled1, and Q2=(Vcomp+Voled2+VSS)Coled2.

Figure 9:
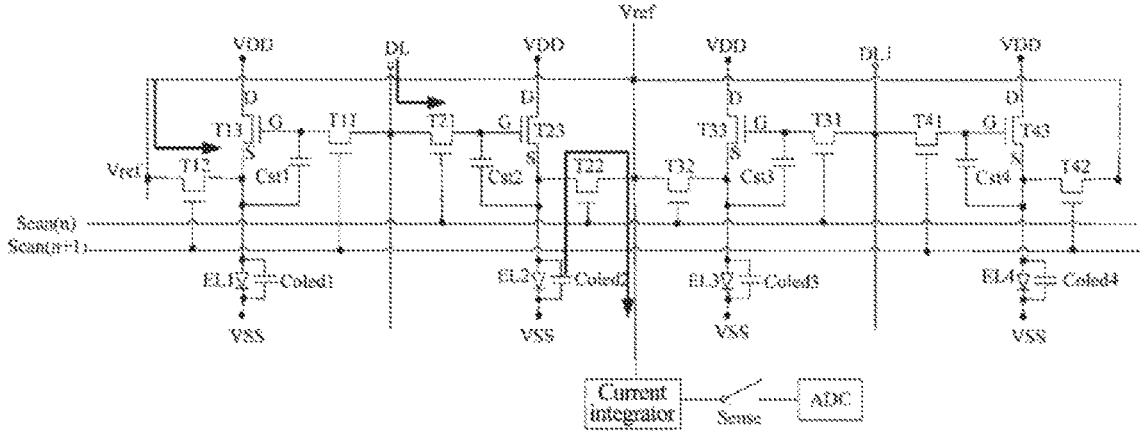
FIG. 9 is a signal flow schematic diagram of a pixel structure in a stage for writing a black pixel according to an embodiment of the present disclosure.

For stage T3, i.e., a first stage for writing a black pixel, an input signal of a first scanning line Scan(n) is a turn-on voltage signal VGH of high level, the second switch transistor T21 and the second detecting transistor T22 are turned on, as shown in FIG. 9, a turn-off data signal Voff of the first data line DL is written into a control pole of the second drive transistor T2*d* through the second switch transistor T21, reference voltage Vref of the induction signal line (here, Vref may be 0V) is written into a source of the second drive transistor T2*d* through the second detecting transistor T22, and the second drive transistor T2*d* is off. In this case, the amount of charge stored in the second detecting capacitor Coled2 decreases due to a coupling effect of the second storage capacitor Cst2. Assuming Coled2/Cst2=a2, gate voltage of the second drive transistor T2*d* is 0 v (it is decided according to a Gama curve for an actual product), and VSS=0 v, then a final amount of charge of the second detecting capacitor Coled2 is:

$$Qf2=(\text{Vcomp}*a2(1+a2)+\text{Voled2})\text{Coled2}.$$

For stage T4, i.e., a first sensing stage, the final amount of charge in the second detecting capacitor Coled2 flows into a current integrator, and an actual measurement value of Qf2 is sensed by an analog-to-digital converter ADC. A voltage difference Voled2 corresponding to the second detecting capacitor Coled2 is obtained according to the actual measurement value of Qf2 and fed back to an external compensator. The compensator performs calculation and stores it into a memory for updating data during a next display period.

For stage T5, i.e., a second stage for writing a black pixel, an input signal of the second scanning line Scan(n+1) is a turn-on voltage signal VGH of high level, the first switch transistor T11 and the first detecting transistor T12 are turned on, a turn-off data signal Voff of the first data line DL is written into a control pole of the first drive transistor T1*d* through the first switch transistor T11, reference voltage Vref (here, Vref may be 0V) is written into a source of the first drive transistor T1*d* through the first detecting transistor T12, and the first drive transistor T1*d* is off. In this case, the amount of charge stored in the first detecting capacitor Coled1 decreases due to a coupling effect of the first storage capacitor Cst1. Assuming Coled1/Cst1=a1, gate voltage of the first drive transistor T1*d* is 0 v (it is decided according to a Gama curve for an actual product), and VSS=0 v, then a final amount of charge of the first detecting capacitor Coled1 is:

$$Qf1=(\text{Vcomp}*a1(1+a1)+\text{Voled1})\text{Coled1}.$$

For stage T6, i.e., a second sensing stage, the final amount of charge in the first detecting capacitor Coled1 flows into the current integrator, and an actual measurement value of Qf1 is sensed by the analog-to-digital converter ADC. A voltage difference Voled1 corresponding to the first detecting capacitor Coled1 is obtained according to the actual measurement value of Qf1 and fed back to the external compensator. The compensator performs calculation and stores it into a memory for updating data during a next display period.

Figure 10:
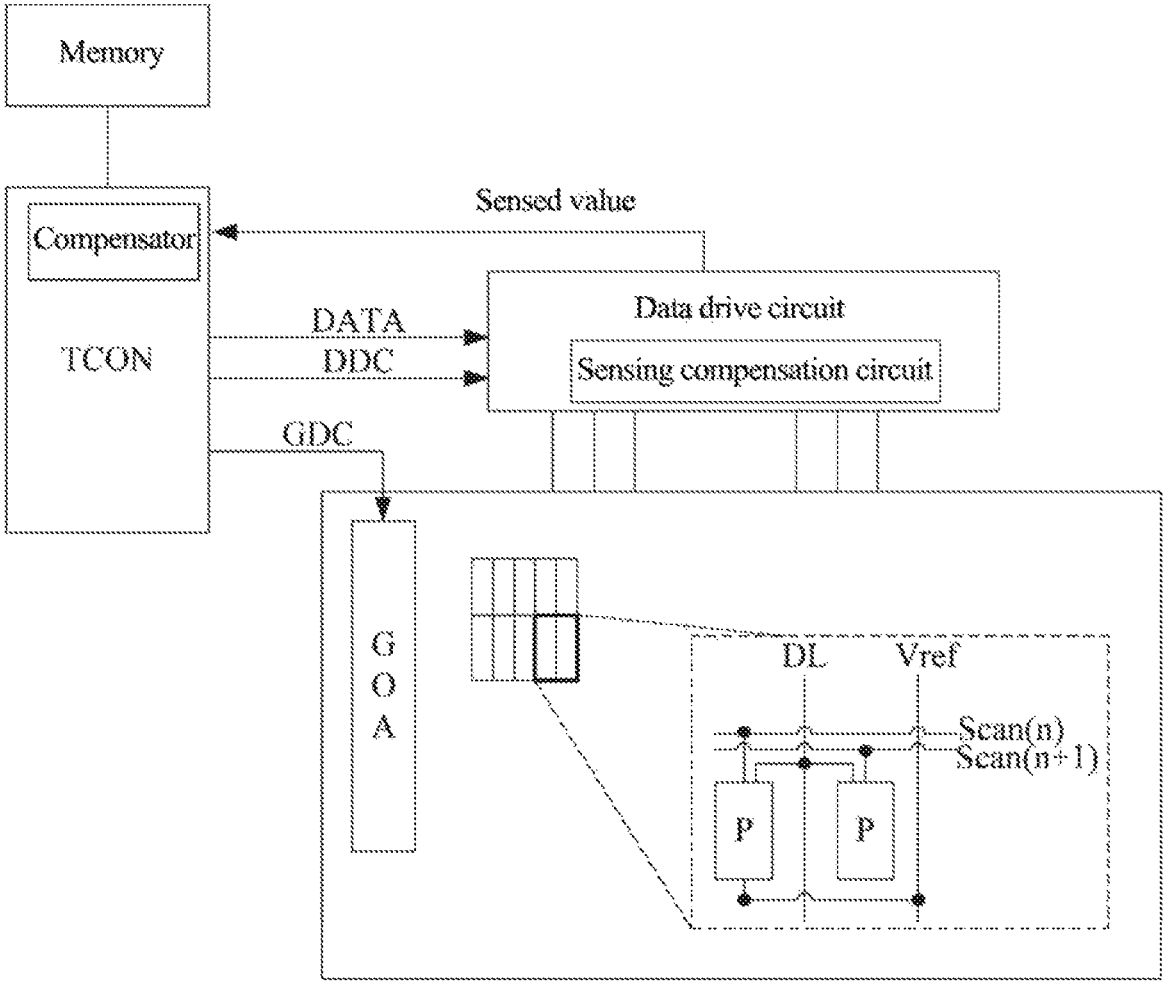
FIG. 10 is a schematic structural diagram of a display panel according to an embodiment of the present disclosure.

As shown in FIG. 10, an embodiment of the present disclosure also provides a display panel, including a pixel structure as described in any one of the above, and further including a sensing compensation circuit, a compensator and a memory, wherein the i-th drive circuit is respectively connected with an induction signal line.

Herein, an input end of the sensing compensation circuit is respectively connected with the induction signal line of the i-th drive circuit, and an output end of the sensing compensation circuit is connected with the compensator, and is configured to acquire an amount of charge flowing through an i-th element to be driven within a preset sensing time, and output the amount of the charge to the compensator.

The compensator is configured to calculate a voltage difference value corresponding to the amount of the charge flowing through the i-th element to be driven within the preset sensing time, obtain a compensation gain value of the i-th element to be driven according to the calculated voltage difference value, and store the compensation gain value in the memory for use during a next display period.

In an exemplary embodiment, the sensing compensation circuit includes a current integrator, a sampling switch and an analog-to-digital converter which are connected in sequence.

Herein, an input end of the current integrator is connected with the induction signal line, and an output end of the current integrator is connected with a first path end of the sampling switch.

A second path end of the sampling switch is connected with an input end of the analog-to-digital converter, and a control end of the sampling switch receives a sampling signal.

An output end of the analog-to-digital converter is connected with the compensator.

In an exemplary embodiment, the amount of the charge flowing through the i-th element to be driven within the preset sensing time and the voltage difference value corresponding to the amount of the charge satisfy:

$$Qfi=(\text{Vcomp}*ai(1+ai)+\text{Voledi})\text{Coledi}.$$

Herein, Qfi is the amount of the charge flowing through the i-th element to be driven within the preset sensing time, Vcomp is induction data voltage, ai is a ratio of an i-th detecting capacitor to an amount of capacitance of an i-th storage capacitor, Voledi is a voltage difference value corresponding to the amount of the charge flowing through the i-th element to be driven within the preset sensing time, and Coledi is an amount of capacitance of the i-th detecting capacitor.

In an exemplary embodiment, the compensation gain value of the i-th element to be driven satisfies: Gaini=Voledi0/Voledi.

Herein, Gaini is the compensation gain value of the i-th element to be driven, Voledi0 is a preset voltage threshold value of the i-th element to be driven, and illustratively, Voledi0 may be a voltage difference value corresponding to an amount of charge flowing through the i-th element to be driven within a preset sensing time when you leave the factory.

In the display panel according to the embodiment of the present disclosure, the compensator is used to calculate the compensation gain value of the corresponding i-th element to be driven according to the voltage difference value corresponding to the amount of the charge flowing through the i-th element to be driven within the preset sensing time, and it is ensured that the organic light emitting diode can still remain consistent luminous brightness even after aging and fading.

An embodiment of the present disclosure provides an OLED compensation design, relating to a 3T2C pixel drive circuit, and reducing, on a premise of not changing a quantity of gate lines, a quantity of data lines by half, which facilitates high PPI to be realized, and does not affect OLED compensation. According to the embodiment of the present disclosure, through a Dual Gate design, a frequency of writing light emission data may be reduced, during the OLED compensation, and compensation time may be shortened. In a compensation OLED stage, when light emission data is written, adjacent sub-pixel units (Sub Pixels) connected by a same data line may be simultaneously written, shortening time for writing the light emission data.

Figure 11:
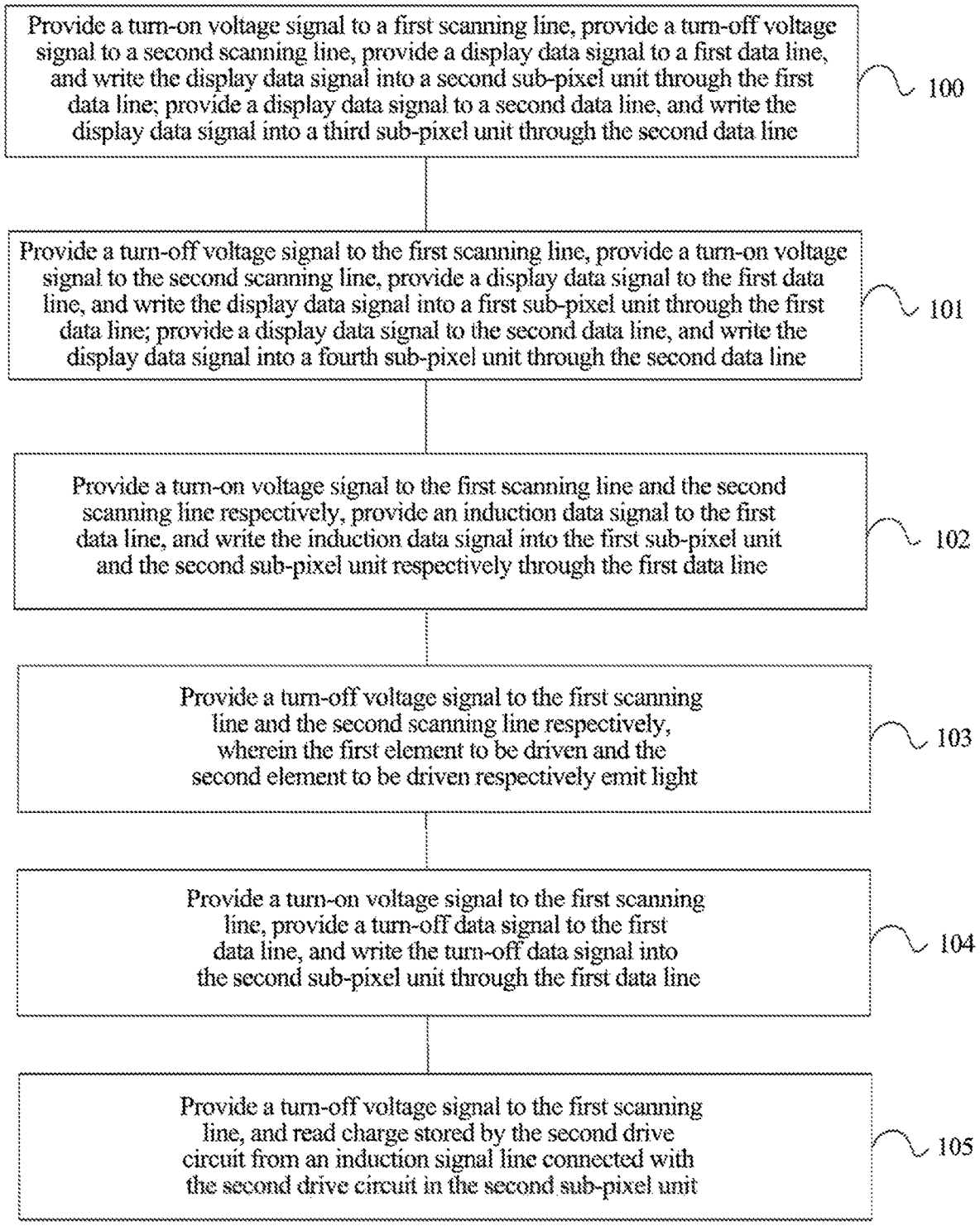
FIG. 11 is a flowchart of a method for controlling a pixel structure according to an embodiment of the present disclosure.

Some embodiments of the present disclosure also provide a method for controlling a pixel structure, applied to the pixel structure according to any one of the aforementioned embodiments. The pixel structure includes: four sub-pixel units, wherein the i-th sub-pixel unit includes an i-th element to be driven and an i-th drive circuit, $1 \leq i \leq 4$. FIG. 11 is a flowchart of a method for controlling a pixel structure according to an embodiment of the present disclosure. As shown in FIG. 11, when display is driven, drive timing of the pixel structure includes: a scanning stage and an induction stage. In the scanning stage, the control method includes following acts 100 to 105.

Herein, act 100 includes: providing a turn-on voltage signal to the first scanning line, providing a turn-off voltage signal to the second scanning line, providing a display data signal to the first data line, and writing the display data signal into the second sub-pixel unit through the first data line; providing a display data signal to the second data line, and writing the display data signal into the third sub-pixel unit through the second data line.

In an exemplary embodiment, the turn-on voltage signal is at a high level, and the display data signal is at a high level.

Act 101 includes: providing a turn-off voltage signal to the first scanning line, providing a turn-on voltage signal to the second scanning line, providing a display data signal to the first data line, and writing the display data signal into the first sub-pixel unit through the first data line; and providing a display data signal to the second data line, and writing the display data signal into the fourth sub-pixel unit through the second data line.

In an exemplary embodiment, the turn-off voltage signal is at a low level, the turn-on voltage signal is at a high level, and the display data signal is at a high level.

In the induction stage, the control method includes following acts.

Act 102 includes: providing a turn-on voltage signal to the first scanning line and the second scanning line respectively, providing an induction data signal to the first data line, and writing the induction data signal into the first sub-pixel unit and the second sub-pixel unit respectively through the first data line.

In an exemplary embodiment, the turn-on voltage signal is at a high level, and the induction data signal is at a high level.

Act 103 includes: providing a turn-off voltage signal to the first scanning line and the second scanning line respectively, wherein the first element to be driven and the second element to be driven respectively emit light.

In an exemplary embodiment, the turn-off voltage signal is at a low level.

Act 104 includes: providing a turn-on voltage signal to the first scanning line, providing a turn-off data signal to the first data line, and writing the turn-off data signal into the second sub-pixel unit through the first data line.

In an exemplary embodiment, the turn-on voltage signal is at a high level, and the turn-off data signal is at a low level.

Act 105 includes: providing a turn-off voltage signal to the first scanning line, and reading charge stored by the second drive circuit from an induction signal line connected with the second drive circuit.

In an exemplary embodiment, the turn-on voltage signal is at a high level, and the turn-off voltage signal is at a low level.

In an exemplary embodiment, in the induction stage, the control method further includes acts 106 to 107.

Act 106 includes: providing a turn-on voltage signal to the second scanning line, providing a turn-off data signal to the first data line, and writing the turn-off data signal into the first sub-pixel unit through the first data line.

Act 107 includes: providing a turn-off voltage signal to the second scanning line, and reading charge stored by the first drive circuit from an induction signal line connected with the first drive circuit.

In an exemplary embodiment, in the induction stage, the control method further includes acts 108 to 113.

Act 108 includes: providing a turn-on voltage signal to the first scanning line and the second scanning line respectively, providing an induction data signal to the second data line, and writing the induction data signal into the third sub-pixel unit and the fourth sub-pixel unit respectively through the second data line.

Act 109 includes: providing a turn-off voltage signal to the first scanning line and the second scanning line respectively, wherein the third element to be driven and the fourth element to be driven respectively emit light.

Act 110 includes: providing a turn-on voltage signal to the first scanning line, providing a turn-off data signal to the second data line, and writing the turn-off data signal into the third sub-pixel unit through the second data line.

Act 111 includes: providing a turn-off voltage signal to the first scanning line, and reading charge stored by the third drive circuit from an induction signal line connected with the third drive circuit.

Act 112 includes: providing a turn-on voltage signal to the second scanning line, providing a turn-off data signal to the second data line, and writing the turn-off data signal into the fourth sub-pixel unit through the second data line.

Act 113 includes: providing a turn-off voltage signal to the second scanning line, and reading charge stored by the fourth drive circuit from an induction signal line connected with the fourth drive circuit.

Figure 12:
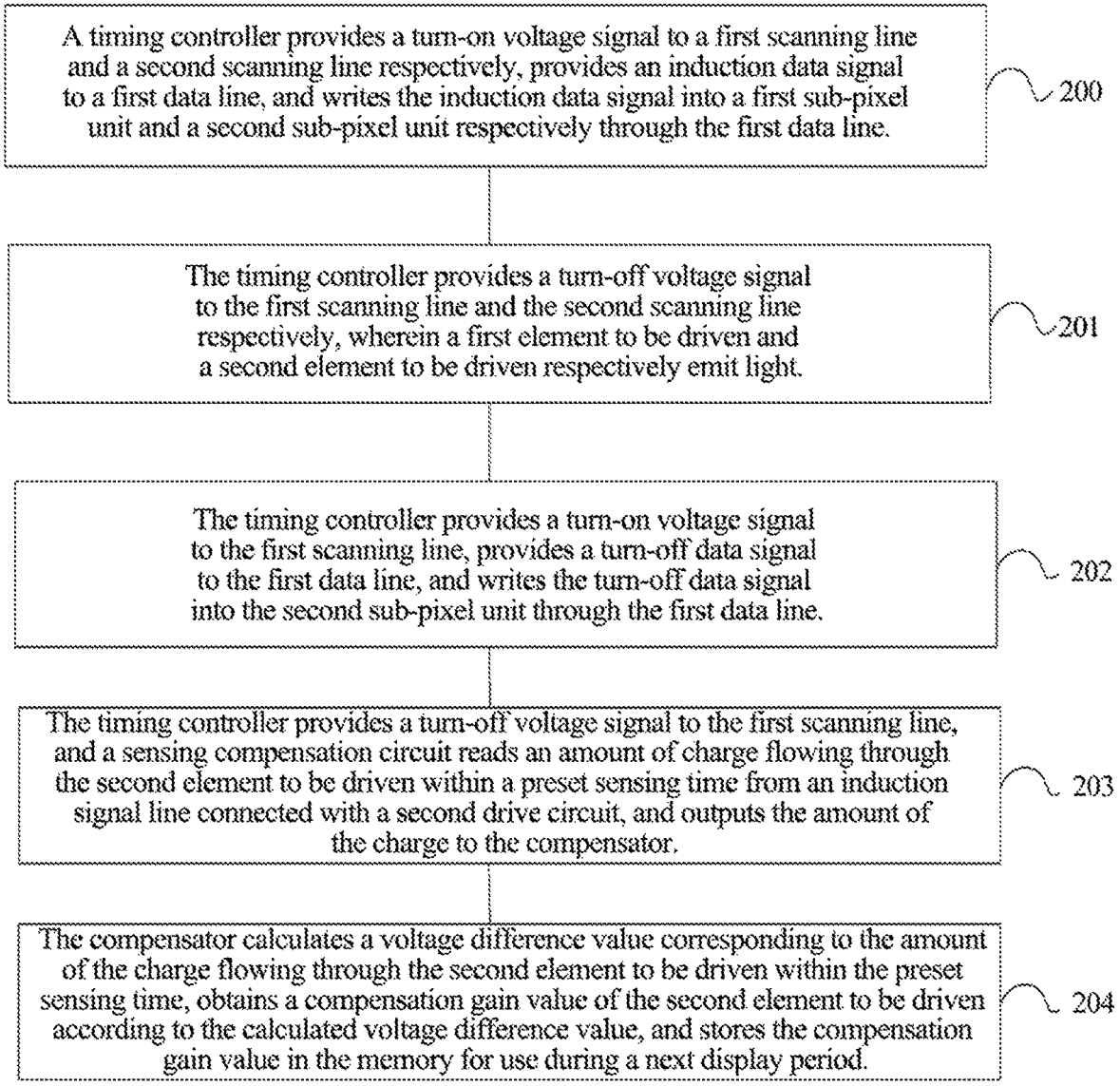
FIG. 12 is a flowchart of a method for controlling a display panel according to an embodiment of the present disclosure.

FIG. 12 is a flowchart of a method for controlling a display panel according to an embodiment of the present disclosure. The display panel includes the pixel structure according to the aforementioned embodiment, and further includes: a timing controller (TCON), a sensing compensation circuit, a compensator and a memory, wherein the i-th drive circuit is respectively connected with an induction signal line. As shown in FIG. 12, the control method includes acts 200 to 204.

Herein, act 200 includes: providing, by the timing controller, a turn-on voltage signal to the first scanning line and the second scanning line respectively, providing an induction data signal to the first data line, and writing the induction data signal into the first sub-pixel unit and the second sub-pixel unit respectively through the first data line.

Act 201 includes: providing, by the timing controller, a turn-off voltage signal to the first scanning line and the second scanning line respectively, wherein the first element to be driven and the second element to be driven respectively emit light.

Act 202 includes: providing, by the timing controller, a turn-on voltage signal to the first scanning line, providing a turn-off data signal to the first data line, and writing the turn-off data signal into the second sub-pixel unit through the first data line.

Act 203 includes: providing, by the timing controller, a turn-off voltage signal to the first scanning line, reading, by the sensing compensation circuit, an amount of charge flowing through the second element to be driven within a preset sensing time from the induction signal line connected with the second drive circuit, and outputting the amount of the charge to the compensator.

Act 204 includes: calculating, by the compensator, a voltage difference value corresponding to the amount of the charge flowing through the second element to be driven within the preset sensing time, obtaining a compensation gain value of the second element to be driven according to the calculated voltage difference value, and storing the compensation gain value in the memory for use during a next display period.

In an exemplary embodiment, in the induction stage, the method for controlling the display panel further includes acts 205 to 207.

Act 205 includes: providing, by the timing controller, a turn-on voltage signal to the second scanning line, providing a turn-off data signal to the first data line, and writing the turn-off data signal into the first sub-pixel unit through the first data line.

Act 206 includes: providing, by the timing controller, a turn-off voltage signal to the second scanning line, reading, by the sensing compensation circuit, an amount of charge flowing through the first element to be driven within a preset sensing time from the induction signal line connected with the first drive circuit, and outputting the amount of the charge to the compensator.

Act 207 includes: calculating, by the compensator, a voltage difference value corresponding to the amount of the charge flowing through the first element to be driven within the preset sensing time, obtaining a compensation gain value of the first element to be driven according to the calculated voltage difference value, and storing the compensation gain value in the memory for use during a next display period.

In an exemplary embodiment, the method for controlling the display panel further includes acts 208 to 212.

Act 208 includes: providing, by the timing controller, a turn-on voltage signal to the first scanning line and the second scanning line respectively, providing an induction data signal to the second data line, and writing the induction data signal into the third sub-pixel unit and the fourth sub-pixel unit respectively through the second data line;

Act 209 includes: providing, by the timing controller, a turn-off voltage signal to the first scanning line and the second scanning line respectively, wherein the third element to be driven and the fourth element to be driven respectively emit light.

Act 210 includes: providing, by the timing controller, a turn-on voltage signal to the first scanning line, providing a turn-off data signal to the second data line, and writing the turn-off data signal into the third sub-pixel unit through the second data line.

Act 211 includes: providing, by the timing controller, a turn-off voltage signal to the first scanning line, reading, by the sensing compensation circuit, an amount of charge flowing through the third element to be driven within a preset sensing time from the induction signal line connected with the third drive circuit, and outputting the amount of the charge to the compensator.

Act 212 includes: calculating, by the compensator, a voltage difference value corresponding to the amount of the charge flowing through the third element to be driven within the preset sensing time, obtaining a compensation gain value of the third element to be driven according to the calculated voltage difference value, and storing the compensation gain value in the memory for use during a next display period.

In an exemplary embodiment, the method for controlling the display panel further includes acts 213 to 215.

Act 213 includes: providing, by the timing controller, a turn-on voltage signal to the second scanning line, providing a turn-off data signal to the second data line, and writing the turn-off data signal into the fourth sub-pixel unit through the second data line.

Act 214 includes: providing, by the timing controller, a turn-off voltage signal to the second scanning line, reading, by the sensing compensation circuit, an amount of charge flowing through the fourth element to be driven within a preset sensing time from the induction signal line connected with the fourth drive circuit, and outputting the amount of the charge to the compensator.

Act 215 includes: calculating, by the compensator, a voltage difference value corresponding to the amount of the charge flowing through the fourth element to be driven within the preset sensing time, obtaining a compensation gain value of the fourth element to be driven according to the calculated voltage difference value, and storing the compensation gain value in the memory for use during a next display period.

In an exemplary embodiment, the amount of the charge flowing through the i-th element to be driven within the preset sensing time and the voltage difference value corresponding to the amount of the charge satisfy:

$$Qfi=(\mathrm{Vcomp}*ai(1+ai)+\mathrm{Voledi})\mathrm{Coledi}.$$

Herein, Qfi is the amount of the charge flowing through the i-th element to be driven within the preset sensing time, Vcomp is induction data voltage, ai is a ratio of an i-th detecting capacitor to an amount of capacitance of an i-th storage capacitor, Voledi is a voltage difference value corresponding to the amount of the charge flowing through the i-th element to be driven within the preset sensing time, and Coledi is an amount of capacitance of the i-th detecting capacitor.

In an exemplary embodiment, the compensation gain value of the i-th element to be driven obtained by the compensator according to the calculated voltage difference value is: Gaini=Voledi0/Voledi; wherein, Gaini is the compensation gain value of the i-th element to be driven, and Voledi0 is a preset voltage threshold value of the i-th element to be driven.

Following several points need to be explained.

The drawings of the embodiments of the present disclosure only refer to the structures involved in embodiments of the present disclosure, and other structures may refer to common designs.

If there is no conflict, the embodiments of the present disclosure, i.e., the features in the embodiments, may be combined with each other to obtain new embodiments.

Although the embodiments disclosed in the present disclosure are as the above, the contents are only embodiments used for facilitating understanding the present disclosure, rather than for restricting the present disclosure. Any person skilled in the art to which the present disclosure pertains may make any modifications and variations in the form and details of practice without departing from the spirit and the scope disclosed in the present disclosure, but the patent protection scope of the present disclosure shall still be subject to the scope defined in the appended claims.

What is claimed is:

1. A display panel, comprising a pixel structure, a sensing compensation circuit, a compensator and a memory; wherein the pixel structure comprises four sub-pixel units, and the i-th sub-pixel unit comprises: an i-th element to be driven and an i-th drive circuit, $1 \le i \le 4$, and the i-th drive circuit is respectively connected with an induction signal line;

the first drive circuit is respectively connected with a first data line and a second scanning line, and is configured to drive the first element to be driven according to a data signal of the first data line under control of the second scanning line;

the second drive circuit is respectively connected with the first data line and a first scanning line, and is configured to drive the second element to be driven according to the data signal of the first data line under control of the first scanning line;

the third drive circuit is respectively connected with a second data line and the first scanning line, and is configured to drive the third element to be driven according to a data signal of the second data line under control of the first scanning line;

the fourth drive circuit is respectively connected with the second data line and the second scanning line, and is configured to drive the fourth element to be driven according to the data signal of the second data line under control of the second scanning line;

an input end of the sensing compensation circuit is respectively connected with the induction signal line of the i-th drive circuit, and an output end of the sensing compensation circuit is connected with the compensator, and is configured to acquire an amount of charge flowing through the i-th element to be driven within a preset sensing time, and output the amount of the charge to the compensator; and the compensator is configured to calculate a voltage difference value corresponding to the amount of the charge flowing through the i-th element to be driven within the preset sensing time, obtain a compensation gain value of the i-th element to be driven according to the calculated voltage difference value, and store the compensation gain value in the memory for use during a next display period;

two sub-pixel units in a same row within a same pixel structure are simultaneously written;

wherein the i-th drive circuit comprises: a drive sub-circuit, a writing sub-circuit, a detecting sub-circuit, a first storage sub-circuit and a second storage sub-circuit;

the drive sub-circuit is respectively connected with a first node, a first power supply end and a second node, and is configured to generate drive current under control of the first node and the second node;

the writing sub-circuit is respectively connected with an M-th data line, an N-th scanning line and the first node, and is configured to provide a data signal of the M-th data line to the first node under control of the N-th scanning line; wherein $$M = \begin{cases} 1, 1 \le i \le 2 \\ 2, 3 \le i \le 4 \end{cases}, N = \begin{cases} 1, 2 \le i \le 3 \\ 2, i \text{ is } 1 \text{ or } 4 \end{cases};$$

the detecting sub-circuit is respectively connected with the N-th scanning line, an induction signal line and the second node, is configured to provide reference voltage provided by the induction signal line to the second node under control of the N-th scanning line, and is further configured to provide a signal of the second node to the induction signal line under the control of the N-th scanning line;

the first storage sub-circuit is respectively connected with the first node and the second node, and is configured to store an amount of charge between the first node and the second node;

the second storage sub-circuit is respectively connected with a second power supply end and the second node, and is configured to store an amount of charge flowing through the i-th element to be driven; and the i-th element to be driven is respectively connected with the second power supply end and the second node;

wherein the drive sub-circuit comprises a drive transistor, the writing sub-circuit comprises a switch transistor, the detecting sub-circuit comprises a detecting transistor, the first storage sub-circuit comprises a storage capacitor, and the second storage sub-circuit comprises a detecting capacitor;

a control pole of the drive transistor is connected with the first node, a first pole of the drive transistor is connected with the first power supply end, and a second pole of the drive transistor is connected with the second node;

a control pole of the switch transistor is connected with the N-th scanning line, a first pole of the switch transistor is connected with the first node, and a second pole of the switch transistor is connected with the M-th data line;

a control pole of the detecting transistor is connected with the N-th scanning line, a first pole of the detecting transistor is connected with the induction signal line, and a second pole of the detecting transistor is connected with the second node;

an end of the storage capacitor is connected with the first node, and another end of the storage capacitor is connected with the second node; and an end of the detecting capacitor is connected with the second node, and another end of the detecting capacitor is connected with the second power supply end;

wherein the amount of the charge flowing through the i-th element to be driven within the preset sensing time and the voltage difference value corresponding to the amount of the charge satisfy:

$$Qfi=(\text{Vcomp}*ai(1+ai)+\text{Voledi})\text{Coledi};$$

wherein Qfi is the amount of the charge flowing through the i-th element to be driven within the preset sensing time, Vcomp is induction data voltage, ai is a ratio of a detecting capacitor of the i-th drive circuit to an amount of capacitance of the storage capacitor, Voledi is a voltage difference value corresponding to the amount of the charge flowing through the i-th element to be driven within the preset sensing time, and Coledi is an amount of capacitance of the detecting capacitor of the i-th drive circuit.

2. The display panel according to claim 1, wherein the sensing compensation circuit comprises a current integrator, a sampling switch and an analog-to-digital converter which are connected in sequence; wherein an input end of the current integrator is connected with the induction signal line, and an output end of the current integrator is connected with a first path end of the sampling switch;

a second path end of the sampling switch is connected with an input end of the analog-to-digital converter, and a control end of the sampling switch receives a sampling signal; and an output end of the analog-to-digital converter is connected with the compensator.

3. The display panel according to claim 1, wherein the compensation gain value of the i-th element to be driven satisfies:

Gaini=Voledi0/Voledi;

wherein Gaini is the compensation gain value of the i-th element to be driven, and Voledi0 is a preset voltage threshold value of the i-th element to be driven.

4. The display panel according to claim 1, wherein induction signal lines of the second drive circuit and the third drive circuit are a same induction signal line.

5. The display panel according to claim 1, wherein the first to the fourth elements to be driven are organic light emitting diodes, micro light emitting diodes, or submillimeter light emitting diodes.

* * * * *